US009938756B2

(12) United States Patent
Hatton et al.

(10) Patent No.: US 9,938,756 B2
(45) Date of Patent: Apr. 10, 2018

(54) DOOR BRACE

(71) Applicants: Penn Elcom Corporation, Tortola (VG); Steve St. James, Encinitas, CA (US)

(72) Inventors: James Hatton, Sussex (GB); Steve St. James, Encinitas, CA (US)

(73) Assignees: Penn Elcom Corporation, Tortola (VG); Steve St. James, British Encinitas, CA (US)

( * ) Notice: Subject to any disclaimer, the term of this patent is extended or adjusted under 35 U.S.C. 154(b) by 0 days.

(21) Appl. No.: 14/002,689

(22) PCT Filed: Dec. 12, 2012

(86) PCT No.: PCT/GB2012/053099

§ 371 (c)(1),
(2) Date: Aug. 30, 2013

(87) PCT Pub. No.: WO2013/093426

PCT Pub. Date: Jun. 27, 2013

(65) Prior Publication Data

US 2014/0375070 A1 Dec. 25, 2014

(30) Foreign Application Priority Data

Dec. 20, 2011 (WO) ..... PCT/GB2011/052533

(51) Int. Cl.
*E05C 17/54* (2006.01)
*E05C 17/44* (2006.01)
(Continued)

(52) U.S. Cl.
CPC ..... *E05C 19/188* (2013.01); *E05C 17/44* (2013.01); *E05C 17/443* (2013.01); *E05C 17/48* (2013.01);
(Continued)

(58) Field of Classification Search
CPC ..... E05C 17/44; E05C 17/443; E05C 17/54; E05C 19/003; E05C 19/004;
(Continued)

(56) References Cited

U.S. PATENT DOCUMENTS 217,762 A * 7/1879 Witte ..... 292/338
692,687 A * 2/1902 Martin ..... 292/338
(Continued)

FOREIGN PATENT DOCUMENTS

EP 2 386 707 A2 11/2011

*Primary Examiner* — Alyson M Merlino
(74) *Attorney, Agent, or Firm* — Muncy, Geissler, Olds & Lowe, P.C.

(57) ABSTRACT

A door brace (10) comprising: an engagement member (12) comprising a bottom flange (14) comprising one face comprising a textured surface (14*a*) to engage with a door (34); an angled leg (20) comprising a first section (22) hingedly connected at one end to the wall and a second section (23) extending from the first section at a first angle, the leg being movable between a stowed position and an extended position in which the first section makes a second angle, larger than the first angle, to the wall; an engagement foot (26) pivotably mounted on a mounting element (24) having an adjustable length; and a hinge stop configured to prevent the leg moving beyond a maximum extended position. Wherein, in an extended position, the second section of the leg extends at a third angle to the wall equal to the difference between the second and first angles and the engagement foot causes a clamping force to be applied to the door.

9 Claims, 6 Drawing Sheets

(51) Int. Cl.
*E05C 19/18* (2006.01)
*E05C 19/00* (2006.01)
*E05C 17/48* (2006.01)
*E05C 17/50* (2006.01)

(52) U.S. Cl.
CPC ..... *E05C 17/50* (2013.01); *E05C 17/54* (2013.01); *E05C 19/004* (2013.01); *E05C 19/18* (2013.01); *E05C 19/182* (2013.01); *Y10T 292/34* (2015.04); *Y10T 292/67* (2015.04)

(58) Field of Classification Search
CPC ..... E05C 19/009; E05C 19/18; E05C 19/184; E05C 19/188; E05C 17/48; E05C 17/50; E05C 19/182
USPC ..... 292/338, 339, 342, 343, 262, 276, 292/288–298, DIG. 15; 16/82, 83, 85, 16/86 R, 86 A; 248/351
See application file for complete search history.

(56) References Cited

U.S. PATENT DOCUMENTS 943,401 A * 12/1909 Ehemann ..... 292/338
1,064,320 A 6/1913 Glindkamp
1,416,703 A * 5/1922 Force ..... E05C 17/446 292/178
1,687,517 A * 10/1928 Sasgen ..... 292/338
1,830,296 A * 11/1931 Siino ..... 292/338
2,058,639 A * 10/1936 Shoolman et al. ..... 292/338
2,073,024 A * 3/1937 Potter ..... 292/338
2,774,622 A * 12/1956 Priebe ..... 292/288
2,798,755 A * 7/1957 Zapotocny ..... 292/342
3,731,341 A 5/1973 Woodruff
4,076,293 A * 2/1978 Valles ..... 292/338
4,666,195 A * 5/1987 Thomas, III ..... 292/338
4,759,577 A * 7/1988 Thomas, III ..... 292/338
4,883,297 A * 11/1989 Smith ..... E05C 19/004 292/339
5,064,232 A * 11/1991 Quarberg ..... 292/339
5,131,701 A * 7/1992 Stepniewski ..... E05B 65/0888 254/39
5,207,464 A 5/1993 Reeves, Jr.
5,503,443 A 4/1996 Tautfest
5,601,319 A 2/1997 Morin
5,787,548 A * 8/1998 Tzen ..... A01G 17/10 16/82
2004/0070217 A1 4/2004 Demlow
2008/0309100 A1 12/2008 Ollinger
2011/0278866 A1* 11/2011 Lee ..... E05C 19/004 292/339
2012/0080891 A1* 4/2012 Bravo ..... 292/251.5

* cited by examiner

DOOR BRACE

TECHNICAL FIELD

The invention relates to a door brace.

BACKGROUND

It can be desirable in many situations to increase the security on a door by, for example, installing a stronger lock or additional locks or bolts at additional locking points around the door. However, it is not always possible or convenient to make these types of permanent installations on a door, for example in a rented home or office, a hotel or hostel room, or in student accommodation. In situations such as these it is desirable to increase the security of a door using non-permanent means. One well known method is to jam a chair under the door handle but unless the chair is of the right size and construction this will not hold the door for long. One solution which has been proposed extends this approach of jamming a door closed by locating a bar at an angle between the door handle and the floor behind the door. While this is an improvement over the use of a chair, the connection between the bar and the door handle is prone to failure and the bar can extend significantly beyond the door, presenting a trip hazard.

An aspect of the invention provides a door brace comprising a door engagement member, an angled leg, an engagement foot and a hinge stop. The door engagement member comprises a bottom flange and an engagement wall. The bottom flange is adapted to be located under a bottom edge of a door and comprises one face comprising a textured surface adapted to engage with the door. The engagement wall as one face adapted to be located against part of one side of the door. The angled leg comprises a first section hingedly connected at one end to an opposite face of the engagement wall and a second section extending from the first section at a first angle. The leg is movable between a stowed position and an extended position in which the first section makes a second angle, larger than the first angle, to the engagement wall. The engagement foot is pivotably mounted on a mounting element provided at the other end of the leg. The length of the mounting element is adjustable to move the engagement foot between a released position and an engagement position. The hinge stop is configured to prevent the leg moving beyond a maximum extended position in which the second angle has a maximum value. In a said extended position, the second section of the leg extends at a third angle to the engagement wall equal to the difference between the second and first angles and the engagement foot in the engagement position causes a clamping force to be applied to the door.

The door brace may be configured with the leg in an extended position to apply a clamping force between the bottom of the door and an area of floor adjacent to the door. With the leg in an extended position, the door brace connects the door to the floor through the leg and the foot, so pushing force applied to the door, acting towards the door brace, forces the foot downwardly, increasing the frictional engagement between the foot and the floor, and forces the door upwardly. With the leg in an extended position and the length of the mounting element selected such that the foot is in an engagement position, the clamping force which is created pre-loads the foot, which may prevent any initial movement of the door and reduce the chances of the foot slipping on the floor.

The angled shape of the leg may enable the door brace to be quickly removed by pulling sharply on the leg. Pulling on the leg reduces friction between the foot pad and the floor, allowing it to be removed.

The textured surface of the bottom flange may enable the door brace to grip the door, which may prevent the door brace slipping out from under the door, for example if the door is rattled back and forward.

The maximum extended angle of the leg is set by the hinge stop. Unlike the prior art, the user is not required to select the angle of the leg should have but can merely to move the leg out to the maximum extended position, which has a preselected angle. This may ensure that the second section of the leg is arranged at an optimal angle in use, to provide optimal bracing to the door. The construction of the door brace for location against part of a lower edge of a door may enable the door brace to have a compact size, smaller than the prior art devices which engage with a door handle. This may increase the portability of the door brace and may make it more convenient for a user to carry the door brace with them to, for example, secure the door of a room in a hostel, hotel or student accommodation.

In an embodiment, the third angle is up to 15 degrees. In an embodiment, the third angle is up to 10 degrees. This may ensure that the clamping force is directed at approximately 10 degrees to the engagement wall, and thus to the side of the door. This may provide optimal engagement of the engagement foot with the floor without transmitting an excessive force on the leg, which may cause mechanical failure of the leg.

In an embodiment, the first angle is approximately 40 degrees and the second angle is approximately 50 degrees. The third angle is approximately equal to the difference between the first and second angles.

In an embodiment, the textured surface comprises a textured element which is attached to the face of the bottom flange by an adhesive.

In an embodiment, the adhesive is a medium strength adhesive having a shear strength which may be overcome by a manually applied pulling force exerted on the door brace when the angled leg is in a said extended position. The shear strength of the adhesive is such that pulling sharply on the door brace will cause the textured element to slip a small distance on the bottom flange, which may allow the door brace to be removed more easily in the event of an emergency.

In an embodiment, the engagement wail and the bottom flange of the door engagement member define a generally L-shaped recess for receiving part of a door at a bottom edge of the door. The door brace may therefore be closely located against the door, for optimal engagement between the door brace and the door.

In an embodiment, the engagement foot has a sole on which a non-slip material pad is provided. The non-slip material may be one of rubber pad and neoprene elastomer. The non-slip pad may improve the engagement between the foot and the floor.

In an embodiment, the non-slip pad further comprises one of a textured surface and gripping teeth of the non-slip material. This may improve the friction between the engagement foot and a floor surface which is not smooth.

In an embodiment, the door brace further comprises gripping element comprising gripping teeth, the gripping element being removably mountable on the engagement foot. The gripping element may be used to improve engagement between the foot and a soft surface, such as carpet, when the leg is in an extended position.

In an embodiment, the engagement foot is mounted on a ball joint on the mounting element. The angle of engagement between the engagement foot and the floor may optimised by pivoting ball joint the foot. This may enable the foot to sit flat on the floor when the leg in an extended position, even when the floor is uneven, for optimal frictional engagement between the foot and the floor.

In an embodiment, the mounting element comprises a threaded bolt mounted in a correspondingly threaded socket in the leg and a correspondingly threaded nut. A strong mechanical coupling may therefore be provided between the mounting element and the leg, which will resist downwards force applied through the leg, and provide strong clamping between the door jammer, the floor and the door.

In an embodiment, the door brace further comprises an adjustable clamp between the leg and the engagement wall. This may provide additional strength to the leg in the bracing position.

DETAILED DESCRIPTION

Figure 1:
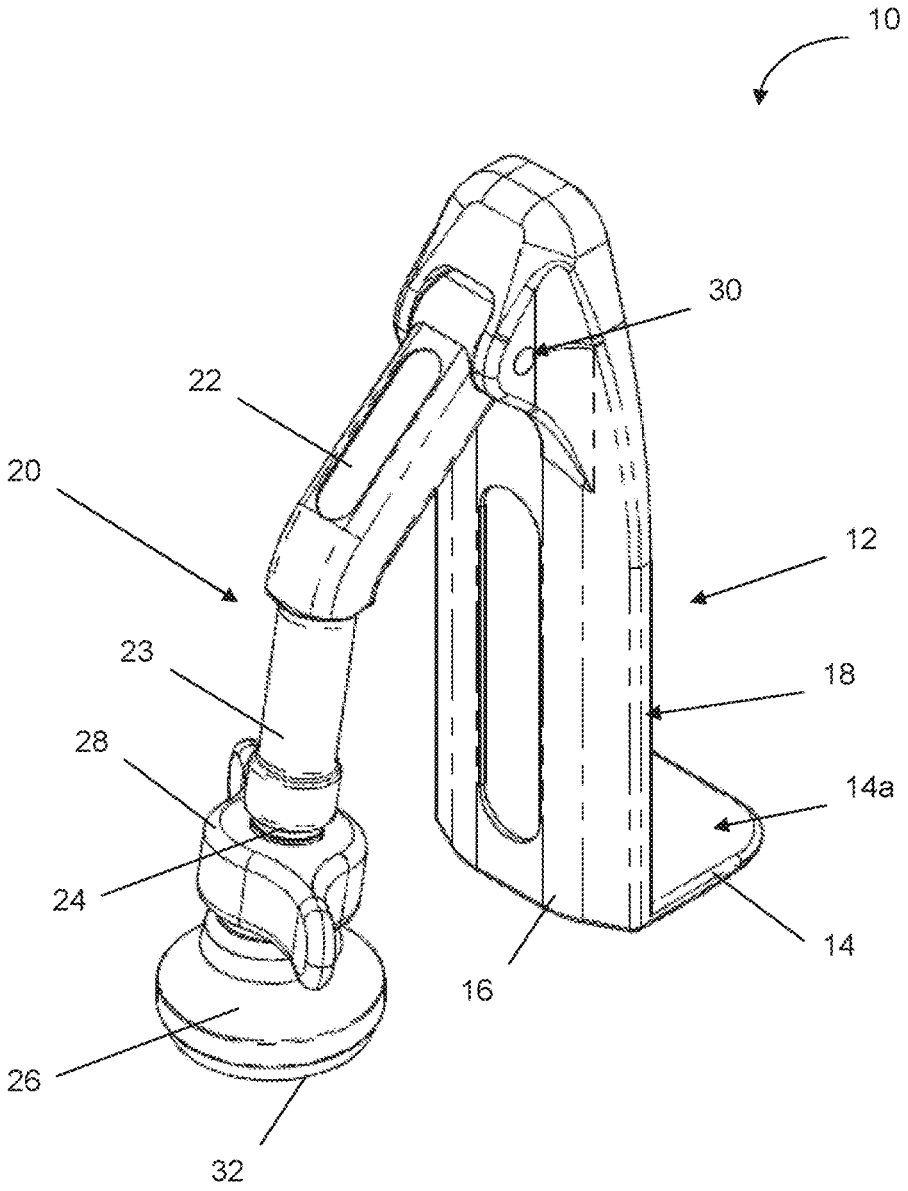
FIG. 1 is a perspective view of a door brace according to a first embodiment of the invention, with the leg in its maximum extended position.

Referring to FIGS. 1 to 4, a first embodiment of the invention provides a door brace 10 comprising a door engagement member 12, an angled leg 20, an engagement foot 26 and a hinge stop 38.

Figure 2:
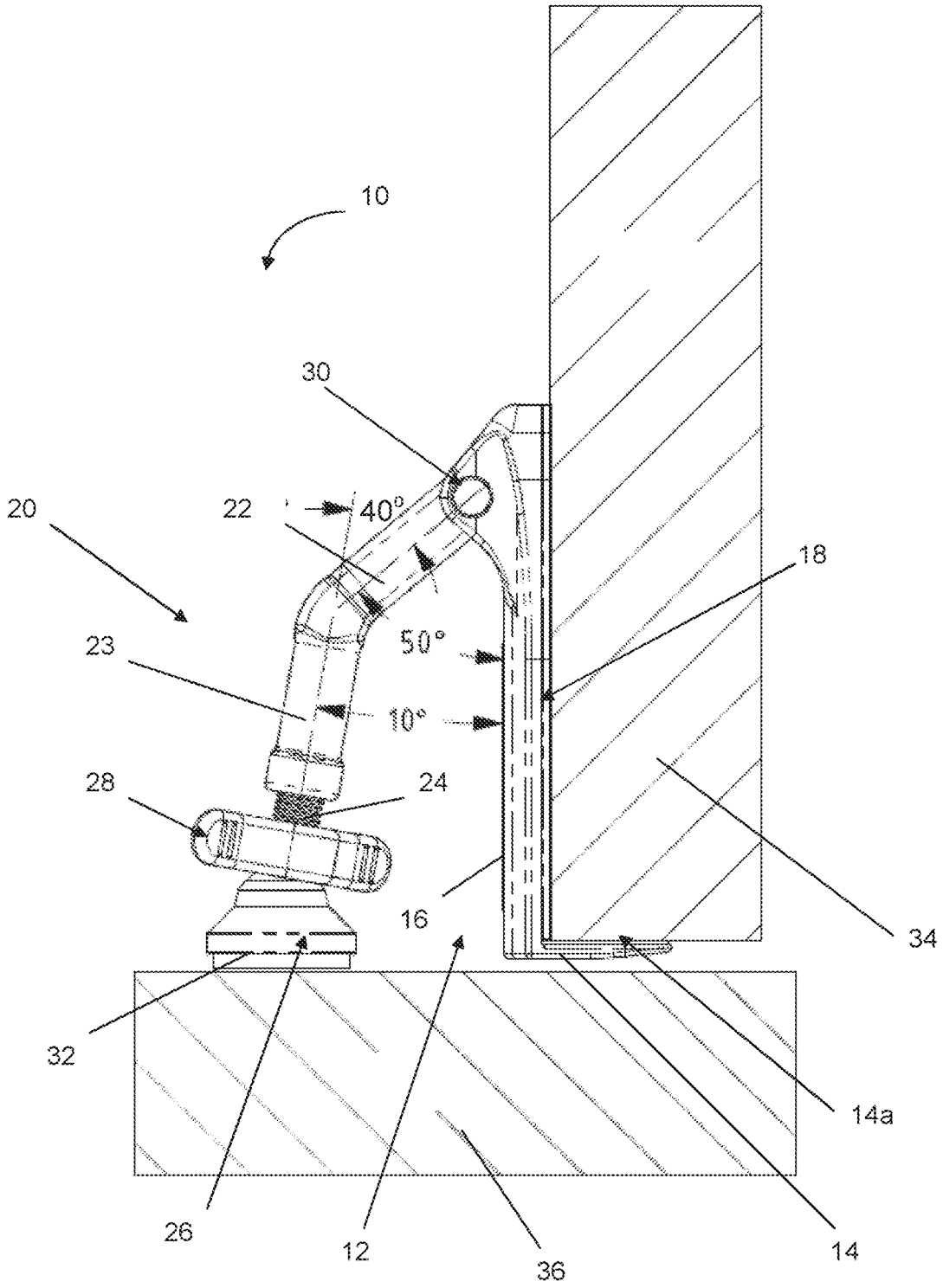
FIG. 2 is a side view of the door brace of FIG. 1 located against a door.

The door engagement member 12 comprises a bottom flange 14 and an engagement wall 16. The bottom flange 14 is adapted to be located under a bottom edge of a door 34, as shown in FIG. 2. The bottom flange comprises a textured surface 14*a* which is adapted to engage with the bottom edge of the door 34, to prevent the door brace slipping out from under the door, for example when the door is rattled.

The engagement wall 16 extends generally upwardly from the bottom flange 14. One face 18 of the engagement wall is adapted to be located against part of one side of the door, at the bottom edge, as shown in FIG. 2. In this example, the engagement wall 16 and the bottom flange 14 together define a generally L-shaped recess for receiving part of the door at its bottom edge.

The angled leg 20 comprises a first section 22 and a second section 23. The first section is hingedly connected at one end to the opposite face of the engagement wall via a hinge pin 30. The second section extends from the first section at a first angle, which in this example is approximately 40 degrees.

Figure 3A:
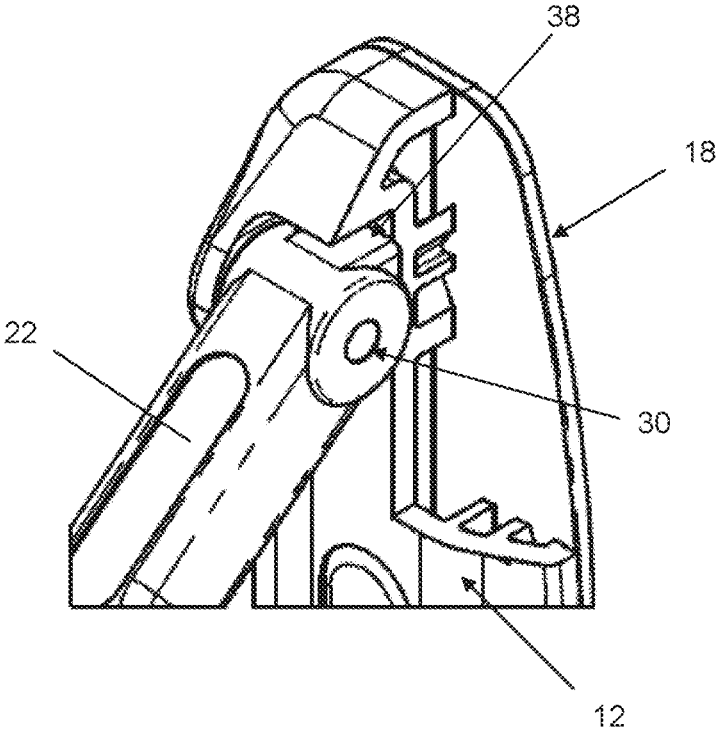
FIG. 3*a* is a part cut away view of part of the door brace of FIG. 1.
Figure 3B:
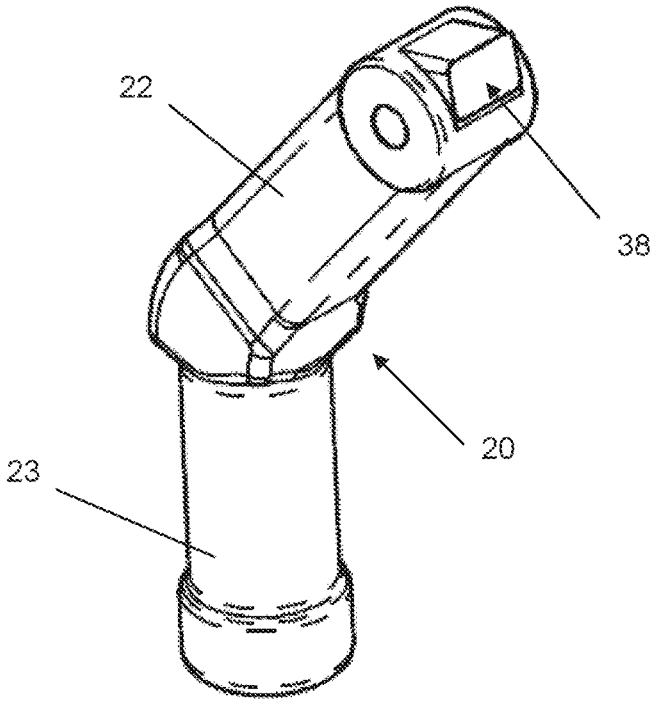
FIG. 3*b* shows the angled leg 20 of the door brace of FIG. 1.
Figure 4:
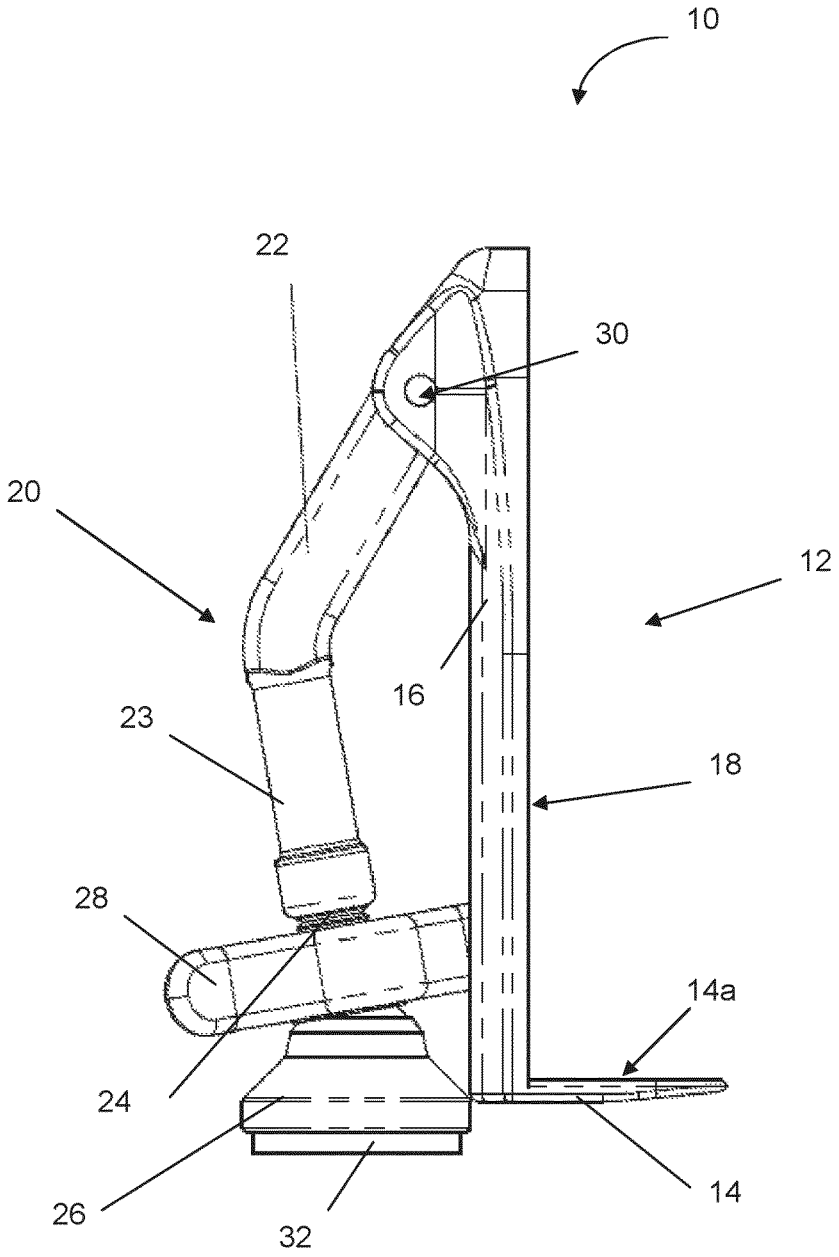
FIG. 4 is a side view of the door brace of FIG. 1 in the stowed position.

The leg 20 is hingedly movable between a stowed position, shown in FIG. 3, and an extended position, shown in FIG. 2, in which the first section 22 makes a second angle to the engagement wall. The second angle is selected to be greater than the first angle so that in an extended position, the second section of the leg extends at a third angle to the engagement wall equal to the difference between the second and first angles.

The engagement foot 26 is pivotably mounted on a mounting element 24, which provided at the other end of the leg 20. The length of the mounting element is adjustable to move the engagement foot between a released position, in which the foot will not engage with the floor in use, and an engagement position, in which the foot will engage with the floor, as shown in FIG. 2. In this example, the mounting element 24 comprises a threaded bolt which is located in a correspondingly threaded aperture within the leg 20. A wing nut 28 is provided which may be turned to cause the threaded bolt 24 to move into or out of the leg to adjust the length of the mounting element, as required.

In this example, the engagement foot 26 is mounted on a ball joint (not visible in the drawings) on the mounting element 24, to enable pivoting of the foot to maximise engagement with the floor. The foot 26 is provided with a non-slip material pad 32, such as rubber or neoprene elastomer pad, on its sole, to provide additional frictional force between the foot 26 and the floor.

The hinge stop 38 is configured to prevent the leg 20 moving beyond a maximum extended position in which the second angle has a maximum value, which in this example is 50 degrees. In an extended position, which may be anywhere between the stowed position shown in FIG. 3 and the maximum extended position shown in FIG. 2, the second section 23 of the leg extends at a third angle to the engagement wall. The third angle is equal to the difference between the first and second angles. In this example, when the leg is in its maximum extended position, the third angle is 10 degrees. In an extended position between the stowed and maximum extended positions the third angle will be less than 10 degrees.

When the leg is in an extended position and the length of the mounting section 24 has been set to bring the engagement foot into an engagement position, the door brace applies a clamping force to the door In use, the length of the mounting element 24 is set so that the engagement foot is in a released position and the bottom flange 14 is located underneath the bottom rail or the lower edge of a stile of the door 34 and the door brace is pushed towards the door until the face 18 of the engagement wall 16 is located against part of one side of the door 34. The angled leg 20 is then hinged outwardly, away from the door into an engagement position, for example the maximum extended position shown in FIG. 2. The length of the mounting element 24 is then increased by turning the wing-nut 28, to move the engagement foot 26 into an engagement position, in which the non-slip pad 32 is brought into secure engagement with the floor 36. In this configuration, a force applied against the door 34, from the side opposite to the one on which the door brace 10 is located, is transferred into the door brace 10 and a downwards component of the force is exerted downwardly through the leg 20 and the engagement foot 26, into the floor 36. An equal and opposite force is exerted upwardly through the leg to the engagement member 12, pushing the door upwardly. Application of external force to the door 34 therefore increases the clamping force applied by the door brace 10 between the door 34 and the floor 36. In its engagement position, the engagement foot 26 is preloaded with force against the floor, thereby preventing initial slipping of the foot 26 when a force is initially applied to the door.

Figure 5:
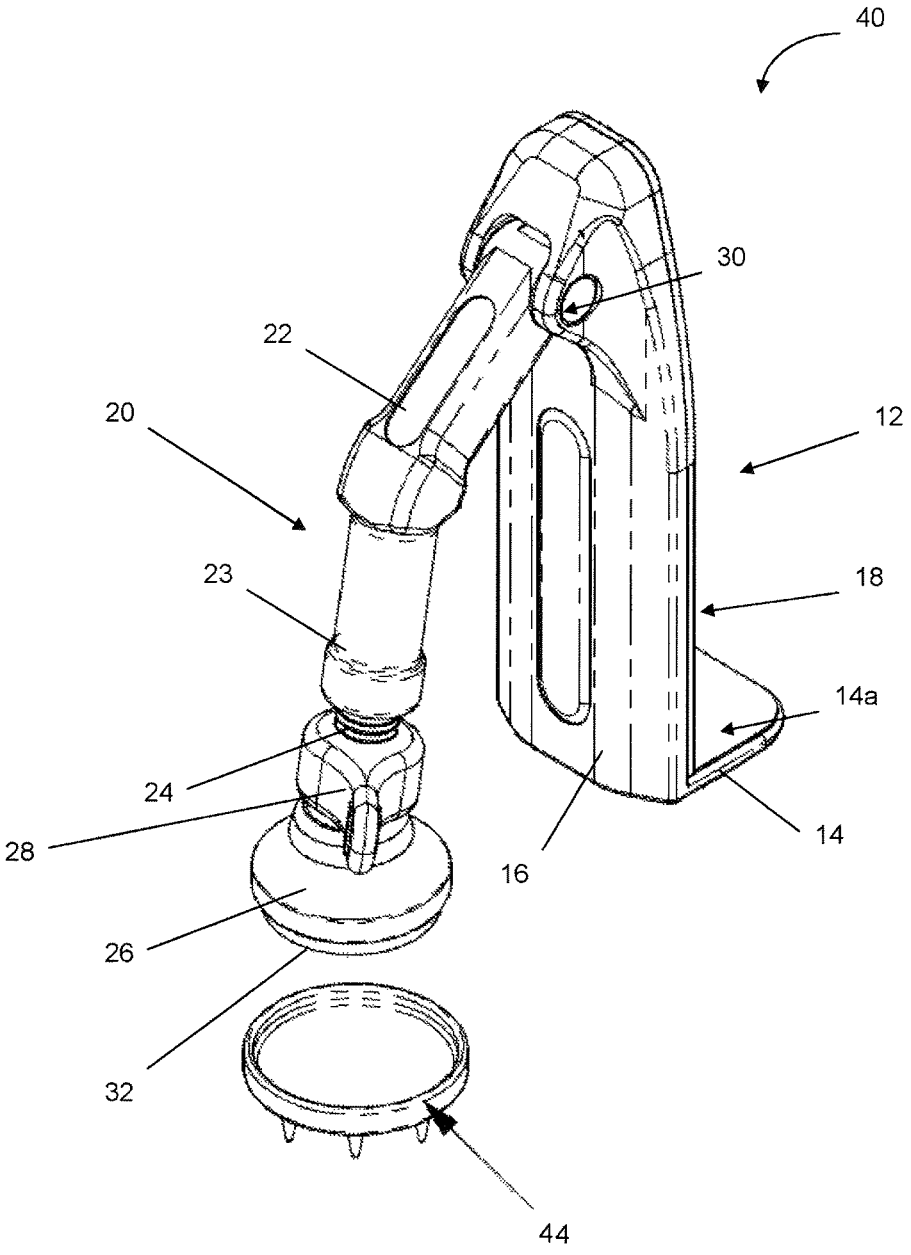
FIG. 5 is a perspective view of a door brace according to a second embodiment of the invention.

A door brace 40 according to a second embodiment of the invention is shown in FIG. 5. The door brace 40 of this embodiment is similar to the door brace 10 of FIGS. 1 to 4, with the following modifications. The same reference numbers are retained for corresponding features.

In this embodiment, the textured surface on the bottom flange 14 comprises a textured element, in this example a pad of textured material, which is attached to the face of the bottom element by an adhesive. The adhesive is a medium strength adhesive, which in this example is a double-sided tape having a shear strength of approximately 4N/cm$^2$. The area of the double-sided tape is approximately 9.5 cm$^2$, giving a total shear strength of approximately 38N. The adhesive may be overcome by a manually applied pulling force of approximately 38N, which is approximately equivalent to 4 kg of force, on the door brace when the angled leg is in an extended position. The shear strength of the adhesive is such that pulling sharply on the door brace will cause the textured pad to slip a small distance on the bottom flange, but the adhesion between the textured pad and the bottom flange 14 will not fail. The resulting slippage of the textured pad enables the door brace to be removed more easily in the event of an emergency.

In this embodiment, the door brace 40 additionally comprises a gripping element 44 comprising gripping teeth. The gripping element is removably mountable on the engagement foot 26. The gripping element may be used when the door brace 40 is located on a soft surface, such as carpet, to improve engagement between the foot and the floor.

Figure 6:
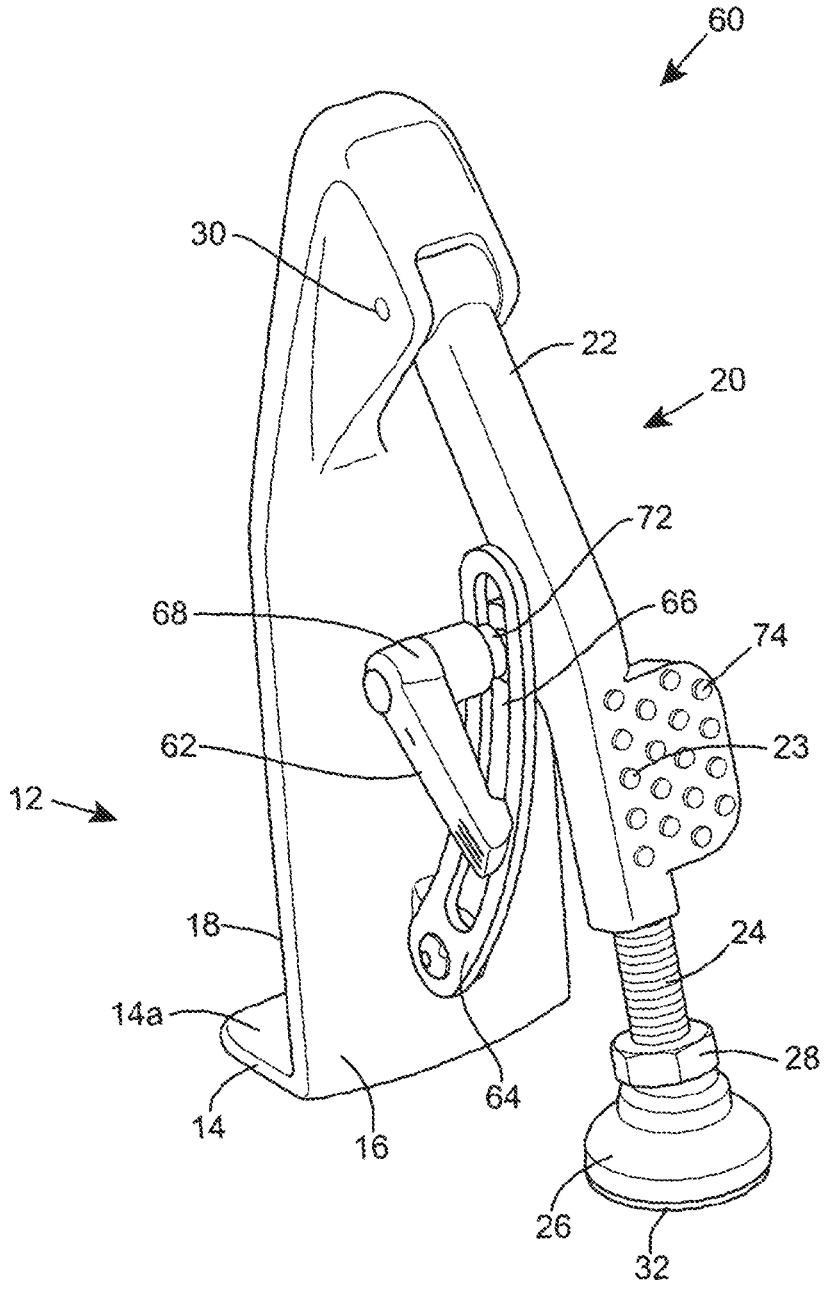
FIG. 6 is a perspective view of door brace according to a third embodiment of the invention.

A door brace 60 according to a third embodiment of the invention is shown in FIG. 6. The door brace 60 of this embodiment is similar to the door brace 10 shown in FIGS. 1 to 4, with the following modifications. The same reference numbers are retained for corresponding features.

In this embodiment the door brace 60 further comprises an adjustable clamp 62 provided between the engagement wall 16 and the first section 22 of the leg 20. The adjustable clamp 62 comprises an arm 64 defining a guide channel 66 arranged to receive an engagement pin 72, provided on the leg 20. A clamp lever 68 is provided on the engagement pin 72 by which the position of the engagement pin within the guide channel 66 may be fixed. The door brace 60 also comprises a kick plate 74, provided on the second section 23 of the leg.

In use, as the leg 20 is moved from its stowed position into an extended position, the engagement pin 72 slides along the guide channel 66, generally away from the engagement wall 16, thereby guiding the leg 20 outwards from the engagement wall. The leg 20 is moved beyond its final position and the door engagement member 12 is located against a door, as described above. The leg 20 is then pushed back towards the door, by a user kicking the kick plate 74, to move the leg 20 into a final extended position.

Once the leg 20 is in its extended position, the clamp lever 68 is adjusted to fix the position of the pin 72, and to retain the leg 20 in the selected extended position. The arm 64 also provides increased engagement between the leg 20 and the engagement wall 16, acting to stabilise the position of the leg 20.

The invention claimed is:

1. A door brace comprising:

a door engagement member comprising a bottom flange and an engagement wall, the bottom flange being adapted to be located under a bottom edge of a door and comprising a face comprising a textured surface adapted to engage with the door, and the engagement wall having a face adapted to be located against part of one side of the door;

an angled leg comprising a first section hingedly connected at one end to an opposite face of the engagement wall and a second section attached to and extending from the first section at a first angle, the leg being movable between a stowed position and an extended position in which the first section makes a second angle, larger than the first angle, to the engagement wall;

an engagement foot mounted on a mounting element comprising a ball joint provided at another end of the second section, the length of the mounting element being adjustable to move the engagement foot between a released position and an engagement position; and a hinge stop configured to prevent the leg moving beyond a maximum extended position in which the second angle has a maximum value, wherein, in said extended position, the second section of the leg extends at a third angle to the engagement wall approximately equal to the difference between the second and first angles and the engagement foot in the engagement position causes a clamping force to be applied to the door, wherein when the engagement foot is in the engagement position and the angled leg is in the extended position, the door brace connects the door to the floor through the first section, through the length of the second section, and the foot, and wherein the position and orientation of the first section of the leg relative to the second section of the leg is equivalent in both the stowed position and the extended position.

2. A door brace as claimed in claim 1, wherein the third angle is up to approximately 10 degrees.

3. A door brace as claimed in claim 2, wherein the first angle is approximately 40 degrees and the second angle is approximately 50 degrees.

4. A door brace as claimed in claim 1, wherein the textured surface comprises a textured element which is attached to the face of the bottom flange by an adhesive.

5. A door brace as claimed in claim 4, wherein the adhesive is a medium strength adhesive having a shear strength which may be overcome by a manually applied pulling force on the door brace.

6. A door brace as claimed in claim 1, wherein the engagement wall and the bottom flange of the door engagement member define a generally L-shaped recess for receiving part of a door at a bottom edge of the door.

7. A door brace as claimed in claim 1, wherein the engagement foot has a sole on which a non-slip material pad is provided.

8. A door brace as claimed in claim 1, wherein the door brace further comprises a gripping element comprising gripping teeth, the gripping element being removably mountable on the engagement foot.

9. A door brace as claimed in claim 1, wherein the door brace further comprises an adjustable clamp.

* * * * *